United States Patent [19]

Dietz, Jr. et al.

[11] 4,092,154

[45] May 30, 1978

[54] ALUMINUM CONTAINING PRECIPITATING AGENT FOR PRECIOUS METALS AND METHOD FOR ITS USE

[75] Inventors: George Dietz, Jr., Watertown, Conn.; Robert M. Skomoroski, Paterson, N.J.

[73] Assignee: American Chemical & Refining Co., Inc., Waterbury, Conn.

[21] Appl. No.: 719,805

[22] Filed: Sep. 2, 1976

[51] Int. Cl.[2] ..... C22B 3/00

[52] U.S. Cl. ..... 75/109; 75/107; 252/188

[58] Field of Search ..... 252/188; 75/109, 107, 75/106; 423/515, 284, 407

[56] References Cited

U.S. PATENT DOCUMENTS

| | | | |
|---|---|---|---|
| 512,046 | 1/1894 | Moldenhauer | 75/107 |
| 1,136,872 | 4/1915 | Hamilton | 75/109 |
| 1,479,542 | 1/1924 | Hirschkind | 75/106 X |
| 2,516,321 | 7/1950 | Hurd et al. | 252/188 |
| 3,271,135 | 9/1966 | Davidoff | 75/108 X |
| 3,271,136 | 9/1966 | Davidoff | 75/108 X |
| 3,669,895 | 6/1972 | Shastri | 252/188 |

*Primary Examiner*—Benjamin R. Padgett
*Assistant Examiner*—E. Suzanne Parr

[57] ABSTRACT

A precipitating agent for precipitating precious metals such as gold from aqueous cyanide solution of the precious metal ions includes aluminum powder and a reducing agent such as sodium hydrosulfite, sodium borohydride or hydrazine. The precipitating agent may also include an alkali metal carbonate, such as potassium carbonate, as an activator. The precipitating agent efficiently reduces the precious metal ions to elemental metal for recovery and also consumes a portion of the cyanide content, which is often high in such solutions.

The method of use includes adjusting the precious metals cyanide solution to a high pH, adding the precipitating agent with agitation, preferably in incremental portions of the amount required. The solution is allowed to stand to permit the precipitated metal to settle, and the metal is separated from the solution.

22 Claims, No Drawings

ALUMINUM CONTAINING PRECIPITATING AGENT FOR PRECIOUS METALS AND METHOD FOR ITS USE

BACKGROUND OF THE INVENTION

The present invention relates to the recovery of precious metals such as gold and silver from aqueous solutions thereof. Generally, the precious metals, e.g., gold are present in the form of cyanide complexes such as potassium or sodium gold cyanide. Such cyanide solutions are obtained or are the by-product of processes such as gold plating, leaching of ores containing precious metals, and stripping of gold or other precious metals from waste material. Although the present invention is particularly concerned with a precipitating agent, and method, for recovering gold from aqueous alkali metal gold cyanide solutions, it is not limited thereto. The problem dealt with by the present invention is generally the recovery of precious metals such as gold, silver, platinum, palladium and rhodium from aqueous cyanide solutions thereof by precipitating the precious metals as elemental metal.

The prior art has devoted attention to this task. For example, U.S. Pat. No. 3,271,135 discloses that the use of zinc dust to precipitate gold from gold cyanide complex solutions is known. This patent proposes as an alternate solution the use of an alkali metal hydrosulfite or hydrazine reducing agent, and an aldehyde group-containing compound to precipitate metallic gold.

U.S. Pat. No. 3,271,136 notes that one difficulty encountered was the tendency of the precipitated gold to redissolve in the solution. This is apparently due to the build-up of alkali metal cyanides in the solution as the gold (or other precious metal) is precipitated from the cyanide complex. This redissolution is sometimes described as a "yo-yo" effect, as precipitated gold is redissolved.

An earlier patent, U.S. Pat. No. 1,426,517 discloses the use of platinum or palladium metal to enhance the ability of hydrazine to reduce nickel compounds in suspension or solution to finely divided elemental nickel suitable for use as a catalyst.

In addition to causing problems of precious metal (e.g., gold) redissolution, the presence of cyanide in the solution after treatment creates problems of waste disposal, since the cyanide compounds are, of course, highly poisonous.

It is accordingly an object of the present invention to provide a novel and efficient precipitating agent for precipitating gold and other precious metals from aqueous alkaline solutions thereof, including aqueous alkaline cyanide solutions.

It is another object of the invention to provide a precipitating agent which, in addition to precipitating the precious metal from solution, destroys a portion at least of the cyanide content, if any, of the solution thereby alleviating problems both of precious metal redissolution and treatment of cyanide waste for disposal.

It is another object of the invention to provide a novel and efficient precipitating agent which contains aluminum powder and which provides recovered gold of extremely high purity.

It is also an object of the present invention to provide a novel method of precipitating precious metals from alkaline aqueous cyanide solutions, and reducing the cyanide content thereof, which method employs the precipitating agent of the invention.

It is also an object of the present invention to provide a novel method of precipitating precious metals from alkaline aqueous solutions, which method employs the precipitating agent of the invention.

Other objects and advantages will appear from the following description.

SUMMARY OF THE INVENTION

The invention provides a precipitating agent for recovering precious metal values from cyanide solutions which contain ions of the precious metals. The precipitating agent comprises aluminum powder and a reducing agent which may be an alkali metal hydrosulfite, an alkali metal borohydride, or a hydrazine compound. Certain objects of the invention are readily attained when the precipitating agent contains about three parts by weight reducing agent to one part by weight aluminum powder. The precipitating agent may further include an alkali metal carbonate, such as potassium carbonate, as an activator for the reducing agents.

Among suitable reducing agents are sodium hydrosulfite, sodium borohydride and hydrazine. Attainment of certain objects of the invention is facilitated when the precipitating agent comprises sodium hydrosulfite, aluminum powder and potassium carbonate in the following approximate proportions of parts by weight: sodium hydrosulfite 6.66 parts; aluminum powder 2.22 parts; and potassium carbonate 1.11 parts. As used in this specification and claims, the term "hydrazine compounds" is deemed to include hydrazine itself as well as compounds containing hydrazine such as hydrazine iodide, hydrazine chloride, hydrazine sulfate, etc.

While proportions of the ingredients may vary, generally the reducing agent should comprise about 40 to 70% by weight of the precipitating agent, the aluminum powder between about 10 to 35% by weight, and the activator between about 10 to 35% by weight.

When the reducing agent is sodium hydrosulfite and the alkali metal carbonate activator is potassium carbonate, the precipitating agent may comprise about 50 to 70% by weight sodium hydrosulfite, 15 to 40% by weight aluminum powder and 10 to 15% by weight potassium carbonate.

When the reducing agent is sodium borohydride and the alkali metal carbonate is potassium carbonate, the precipitating agent may comprise about 60 to 70% by weight sodium borohydride, 10 to 30% by weight aluminum powder and 10 to 20% by weight potassium carbonate.

When the reducing agent is hydrazine and the alkaline metal carbonate is potassium carbonate, the precipitating agent may comprise about 40 to 50% by weight hydrazine, 15 to 35% by weight aluminum powder and 25 to 35% by weight potassium carbonate.

A method for the precipitation of precious metal ions and partial destruction of cyanides in aqueous solutions of precious metal cyanides involves the following steps. An alkaline cyanide solution containing precious metal ions is heated to a temperature of at least about 100° F (37.7° C). Then there is added to the solution the precipitating agent of the invention to precipitate elemental precious metals from the solution. The precipitating agent is preferably added in increments of the total amount required, with agitation to disperse the precipitating agent through the solution. The precipitating agent comprises, as above stated, aluminum powder and a reducing agent which may be an alkali metal hydrosulfite, alkali metal borohydride or a hydrazine compound. Precipitated metal is separated from the solution in any suitable manner.

The method may include as a preliminary step checking the pH of the solution and, if it is below a desired level, adjusting the pH to about 12 or higher, preferably to about 13 or higher, prior to adding the precipitating agent of the invention. The method may also include, as the mode of separating the precipitated metal, allowing the solution to stand after adding the precipitating agent to permit the precipitated metal to settle, and decanting the supernatant liquid from the settled metals.

DESCRIPTION OF THE PREFERRED EMBODIMENTS

An essential component of the precipitating agent of the invention is aluminum powder. Aluminum, as explained in more detail below, does not form metal complexes with cyanide ions. Aluminum powder is commercially available and while specific particle size is not critical to the practice of the present invention, the aluminum should be in the form of a powder or dust since the small particle size provides a larger surface area for reaction. Generally, for satisfactory results in practicing the invention, the aluminum powder particle size should be such that at least 90% of the particles will pass through a 200 mesh screen. The mesh size refers to the ASTM sieve designation for the dimensions for wire cloth of standard test sieves, USA Standard Series. Generally, the smaller the aluminum particle size is, the better. The lower limit on particle size is determined by economic considerations and commercial availability. A particle size in which at least 90% of the particles pass through a 325 mesh screen is preferred.

The reducing agent employed with the aluminum powder may be an alkali metal hydrosulfite, an alkali metal borohydride or a hydrazine compound. Although other, similar reducing agents may be used, sodium hydrosulfite, sodium borohydride and hydrazine are convenient and commercially available at reasonable prices. While the borohydride is the most expensive of the three, it is projected that increased supplies will make it available at an economical price for use in the process. Although the above-mentioned reducing agents are all generally satisfactory, sodium hydrosulfite has been found to also be particularly effective in that it overcomes certain filtering and settling problems caused by metal aluminates. That is, with other reducing agents, formation of some metal aluminates causes a lack of settling and passage through filter media of some of the metal values. This problem is overcome when sodium hydrosulfite is the reducing agent. Further, sodium hydrosulfite is particularly effective in attacking oxidizing agents such as nitrobenzoids often found in, e.g., gold stripping solutions. For these reasons, and because of its relatively low cost and ease of handling, sodium hydrosulfite is the preferred reducing agent.

Although satisfactory results are obtainable with the aluminum powder-reducing agent combination, the speed of the reaction was found to be increased by adding as a component of the precipitating agent an alkali metal carbonate activator. The speed and completeness of the reaction were found to be enhanced by the inclusion of the activator as a substantial component of the precipitating agent. Potassium carbonate was found to provide highly satisfactory results and is readily available and, as such, is a preferred activator.

As stated above, aluminum, unlike most other polyvalent metal ions in solution, does not form a stable complex with cyanide. In alkaline solution at least, aluminum reacts even in the presence of cyanide ions to yield hydrogen. As set forth below, this is believed to explain the surprising ability of aluminum to destroy a portion of the cyanide ions in solution as well as to contribute to the reduction of precious metal ions. For several reasons, it has surprisingly been found that when aluminum is employed as a component of the precipitating agent, not only is excellent recovery of high purity precious metals attained, but a substantial amount of cyanide ion is destroyed by conversion to other chemical species. For example, up to one half of the total cyanide content of a typical gold stripping solution is removed by employing the precipitating agent of the invention. Without wishing to be bound thereby, it is believed that the following reactions typify the mechanism by which aluminum functions in the practice of the invention.

It is known that aluminum will react in highly alkaline solution to form atomic hydrogen as follows:

$$Al + OH^- + 2H_2O \rightarrow H_2AlO_3^- + 3H \quad (1)$$

With alkali metal ions in solution, the reaction may be expressed as follows:

$$Al + NaOH + H_2O \rightarrow NaAlO_2 + 3H \quad (2)$$

$$2H \rightarrow H_2 \quad (2a)$$

The hydrogen produced per the above reaction will react with, e.g., gold ion, in solution as follows:

$$Au^+ + H \rightarrow Au^{\bullet} \downarrow + H^+ \quad (3)$$

The hydrogen so produced is also reactive enough in alkaline solution to react with cyanide as follows:

$$HCN + 2H_2 \rightarrow \underset{\text{(methyl amine)}}{CH_3NH_2} \quad (4)$$

By the above equations, 1 mol of aluminum will provide 1½ mols of hydrogen. Thus, each mol of aluminum is the stoichiometric equivalent of ¾ mol of cyanide (equation (4)) or 3 mol of gold (equation (3)).

While relative proportions of reducing agent to aluminum powder may vary, the proportion of about three parts by weight sodium hydrosulfite to one part by weight aluminum powder has been found to be the most effective in overcoming the filtering and settling problems associated with metal aluminates. Accordingly, the three to one weight ratio provides the best purity of recovered gold and is preferred.

The three to one ratio of reducing agent to aluminum is preferably maintained when the activator is included in the formulation. In such case, the activator is preferably added in the relative proportion of being present in about one part by weight activator for each two parts by weight reducing agent. Thus, preferably the activated precipitating agent contains the ingredients in the proportions of about six parts by weight reducing agent, two parts by weight aluminum powder, and one part by weight activator.

In preparing the precipitating agent, the ingredients are admixed prior to use to provide an intimate admixture of aluminum powder, reducing agent and (when used) activator particles. The ingredients may be mixed in a simple cone blender or other mixing device. Milling or grinding the ingredients together is not necessary.

The amount of reducing agent employed will depend on the nature of the solution, primarily the amount of precious metal contained therein. Generally, a total of about one pound (453.6 grams) of the reducing ingredients (aluminum and the reducing agent) are required to precipitate 20 troy ounces (622 grams) of gold from solution. If the particular solution is high in oxidizers which consume a proportion of the reducing ingredients, additional amounts may be required. In order to obtain substantially complete reduction of the precious metal, obviously at least the stoichiometric amount of reducing agent, in excess of that amount of reducing agent consumed by oxidizers, will be required. In practice, an excess over the stoichiometric amount of reducing materials is provided to drive the reaction in a favorable direction. Experience will show in any given case the amount of the precipitating agent required to efficiently treat a given solution.

In use, the solution containing the precious metal cyanide has added to it the required amount of precipitating agent. The agent may be added in incremental amounts over the surface of the solution, with moderate agitation to distribute the precipitating agent through the solution. It is generally advantageous to divide the total amount of precipitating agent required into four or five equal increments and to agitate the solution for a brief period between additions. Generally, up to about one-quarter hour, e.g. 10 to 15 minutes, of agitation between incremental additions is satisfactory.

The cyanide solution of precious metal ions must be highly alkaline to successfully carry out the process. Preferably, the pH should be about 12 or higher. Therefore, a preliminary step to carrying out the method of the invention may be to test the pH of the solution and, if required, to adjust it to a pH of 12 or higher. This may be accomplished by the addition of a caustic such as sodium hydroxide or potassium hydroxide to the solution. The pH is preferably checked and adjusted, if necessary, between the incremental additions.

The solution should be treated at an elevated temperature, above about 100° F (37.8° C), preferably between about 100° to 120° F (37.8° to 48.9° C). The temperature of the solution is therefore monitored and heat applied as needed.

If at any time it appears that the reaction is not proceeding properly, as may be determined by known test means, the pH and temperature of the solution should be checked to be sure that both are high enough. Generally, increasing the temperature and increasing the pH both favor the precipitating reaction.

After the entire quantity of precipitating agent has been added, the solution is allowed to stand and the precipitated metal particles to settle. This may occur in as little as 2 to 3 hours, or overnight. Other separation means such as centrifuging may be employed to separate the precipitated metal. However, it is preferred to allow the precipitated metal to settle and to separate the supernatant solution from the particles as by decanting. The supernatant solution will appear clear and tests show that it generally contains 10 or less parts per million by weight gold. This small residual amount of gold may be recovered from the supernatant solution by ion exchange or other means.

By treatment with the precipitating agent in accordance with the invention the supernatant solution will also have its cyanide content substantially reduced.

The following examples show the use of the precipitating agent of the invention and typical formulations.

EXAMPLE 1

| | % by Weight |
|---|---|
| Sodium borohydride | 65 |
| Aluminum powder | 20 |
| Potassium carbonate | 15 |

EXAMPLE 2

| | % by Weight |
|---|---|
| Hydrazine | 45 |
| Aluminum powder | 25 |
| Potassium carbonate | 30 |

EXAMPLE 3

| | |
|---|---|
| Sodium hydrosulfite | 66.6 |
| Aluminum Powder | 22.2 |
| Potassium Carbonate | 11.1 |

A typical gold stripper solution is an aqueous solution which includes $KAu(CH)_2$ (potassium gold cyanide), NaCN and NaOH. Typically a gold stripper solution will contain between about ¼ to 6 troy ounces of gold per gallon of solution (2.1 to 49.2 grams per liter). Gold electroplate solutions are similar but generally contain between ¼ to 2 troy ounces of gold per gallon of solution (2.1 to 16.4 grams per liter). Normally, gold electroplate solutions contain relatively little free cyanide whereas gold stripper solutions contain abundant free cyanide.

EXAMPLE 4

A gold stripper solution is heated to between 38° to 49° C and its pH is adjusted to over 13 by addition of sodium hydroxide. The precipitating agent of Example 3 is added to the solution in the amount of at least ½ pound of precipitating agent per ounce of gold. The total amount required is added in five equal increments by spreading the precipitating agent over the surface of the liquid and stirring. Ten to fifteen minutes is allowed between additions of precipitating agent. After all the precipitating agent has been added, the solution is allowed to cool and stand overnight while precipitated gold settles. The supernatant solution is decanted and tested for gold and cyanide content. The gold content is less than ten ppm and the cyanide content is reduced by an amount of cyanide (measured as $CN^-$) equivalent to about one-fourth the weight of the precipitating agent added.

Generally, gold precipitated from solution by the precipitating agent of the invention is of higher quality and fineness than that precipitated by prior precipitating agents. From high grade solutions, gold of 99.9+% purity can be recovered. In contrast, gold recovered by zinc precipitating agents from similar high grade solutions invariably require refining to attain similar purity levels.

Use of the precipitating agent of the invention is not limited to cyanide-containing solutions. The efficient precipitation and the high purity precipitate obtained by employing the precipitating agent of the invention warrants its use even when there is no cyanide disposal problem.

Exemplary of solutions other than gold stripping solutions which may advantageously be treated by the precipitating agent of the invention are the following:

Gold Sulfite Electroplating Baths

A typical sulfite electroplating bath is an aqueous solution including sodium gold sulfite, about 5 to 10 troy ounces per gallon (41.1 to 82.2 grams per liter) of sodium sulfite, and brighteners such as arsenic or cadmium metal in amounts up to about 500 ppm. The aqueous solution usually has a pH of 8 to 12 and contains between one-quarter to 3 troy ounces per gallon (2.1 to 24.7 grams per liter) of gold.

Gold Chloride Electroplating Baths

These solutions typically contain between about ¼ to 3 troy ounces per gallon (2.1 to 24.7 grams per liter) of gold as potassium gold chloride, and 2 to 4 av. ounces per gallon (15 to 30 grams per liter) of salt (sodium chloride), 13.2 to 52.8 cc./liter of ethylene diamine and 26.4 to 79.3 cc per liter of hydrochloric acid. The solution pH is usually about 0.5 to 4.

Gold Cyanide Electroplating Baths

In addition to a gold content of about ¼ to 2 troy ounces per gallon (2.1 to 16.4 grams per liter) the aqueous solution usually contains about 5 to 10 av. ounces per gallon (37.5 to 75. grams per liter) of sodium citrate and up to about 300 ppm of cobalt metal as a brightener. Between ¼ to 6 troy ounces per gallon (2.1 to 49.4 grams per liter) of gold is present, usually in the form of potassium gold cyanide. The solution typically has a pH of 3 to 6.

Solutions such as the foregoing may advantageously be treated in a manner similar to that set forth in Example 4, and the result is that a fine, very pure, i.e., generally 99.9+%, gold is obtained. It will be noted that the sulfite and chloride electroplating baths do not contain cyanide.

The formation of metal aluminates such as potassium or sodium aluminates may have a tendency, due to the gelatinous nature of these substances, to plug up filter media when filtration or centrifuging is employed to effect separation of the precipitate from the solution. However, this problem is overcome by providing the reducing agent and aluminum powder in the specified proportions. Sodium hydrosulfite is particularly advantageous, in overcoming filtration problems which might otherwise be posed by the formation of metal aluminates.

As used in this specification and claims, the term "hydrazine compounds" is deemed to include hydrazine itself as well as compounds containing hydrazine such as, e.g., hydrazine iodide, hydrazine chloride, hydrazine sulfate, etc.

Having thus described the invention, we claim:

1. A precipitating agent for recovering precious metal values from aqueous alkaline solutions containing ions of the precious metals and reducing the cyanide content, if any, of such solutions, comprising: an admixture of aluminum powder and a reducing agent selected from the class consisting of alkali metal hydrosulfite, alkali metal borohydride and hydrazine compounds.

2. The precipitating agent of claim 1 containing about 3 parts by weight reducing agent to 1 part by weight aluminum powder.

3. The precipitating agent of claim 1 further including as an activator an alkali metal carbonate.

4. The precipitating agent of claim 3 comprising about 40 to 70% by weight reducing agent, about 10 to 35% by weight aluminum powder and about 10 to 35% by weight activator.

5. The precipitating agent of claim 4 wherein said reducing agent is selected from the class consisting of sodium hydrosulfite, sodium borohydride and hydrazine, and said alkali metal carbonate is potassium carbonate.

6. The precipitating agent of claim 4 wherein said reducing agent is sodium hydrosulfite and said alkali metal carbonate is potassium carbonate.

7. The precipitating agent of claim 6 comprising about 50 to 70% by weight sodium hydrosulfite, 15 to 40% by weight aluminum powder and 10 to 15% by weight potassium carbonate.

8. The precipitating agent of claim 7 wherein said sodium hydrosulfite, aluminum powder and potassium carbonate are present in the following approximate proportions:

| | Parts by Weight |
|---|---|
| sodium hydrosulfite | 6.66 |
| aluminum powder | 2.22 |
| potassium carbonate | 1.11 |

9. The precipitating agent of claim 5 wherein said reducing agent is sodium borohydride.

10. The precipitating agent of claim 9 comprising about 60 to 70% by weight sodium borohydride, 10 to 30% by weight aluminum powder, and 10 to 20% by weight potassium carbonate.

11. The precipitating agent of claim 5 wherein said reducing agent is a hydrazine compound.

12. The precipitating agent of claim 11 comprising about 40 to 50% by weight hydrazine, 15 to 35% by weight aluminum powder, and 25 to 35% by weight potassium carbonate.

13. The precipitating agent of claim 1 wherein the aluminum powder is of a particle size such that at least 90% of the aluminum particles pass through a 200 mesh screen.

14. The precipitating agent of claim 13 wherein the aluminum powder is of a particle size such that at least 90% of the aluminum particles pass through a 325 mesh screen.

15. A method for the precipitation of precious metal ions from aqueous alkaline solution of said ions and for reducing the cyanide content, if any, of the solution comprising the steps of:

a. heating an aqueous alkaline solution of precious metal ions to a temperature of at least about 37.7° C;

b. adding to said solution a precipitating agent comprising an admixture of aluminum powder and a reducing agent selected from the class consisting of alkali metal hydrosulfite, alkali metal borohydride and hydrazine compounds to precipitate elemental precious metal; and c. separating precipitated precious metal from the solution.

16. The method of claim 15 wherein the precipitating agent further includes as an activator an alkali carbonate.

17. The method of claim 16 further including the preliminary step of testing the pH of the solution, and maintaining the pH at about 12 or higher.

18. The method of claim 16 wherein said precipitating agent is added in increments and agitation of said solution to disperse said precipitating agent therein is carried out between the incremental additions of precipitating agent.

19. The method of claim 15 wherein said reducing agent is sodium hydrosulfite, said alkali carbonate is potassium carbonate and said precipitating agent contains about 50 to 70% by weight sodium hydrosulfite, 15 to 40% by weight aluminum powder and 10 to 15% by weight potassium carbonate.

20. The method of claim 15 wherein said solution is a cyanide solution and further including maintaining said solution at a pH of 12 or higher.

21. The precipitating agent of claim 2 further including as an activator an alkali metal carbonate.

22. The precipitating agent of claim 21 wherein said activator is potassium carbonate.

* * * * *